US006227766B1

(12) United States Patent
Cook

(10) Patent No.: US 6,227,766 B1
(45) **Date of Patent: *May 8, 2001**

(54) DIVE RESCUE SEARCH DEVICE AND METHOD

(76) Inventor: Patrick D. Cook, 7215 Manor Dr., Crystal Lake, IL (US) 60014

( * ) Notice: Subject to any disclaimer, the term of this patent is extended or adjusted under 35 U.S.C. 154(b) by 0 days.

This patent is subject to a terminal disclaimer.

(21) Appl. No.: 09/352,500

(22) Filed: Jul. 10, 1999

Related U.S. Application Data

(63) Continuation-in-part of application No. 09/182,704, filed on Oct. 29, 1998, now Pat. No. 6,042,302.

(51) Int. Cl.[7] ..... B63C 11/02

(52) U.S. Cl. ..... 405/186; 405/185; 405/188

(58) Field of Search ..... 405/185, 186, 405/188, 189, 191–195.1; 114/312, 315

(56) References Cited

U.S. PATENT DOCUMENTS

| | | | | |
|---|---|---|---|---|
| 404,390 | * | 6/1889 | Dutton | 405/185 X |
| 1,238,952 | * | 9/1917 | Stelzner | 405/186 |
| 1,423,923 | * | 7/1922 | Eckert, Jr | 405/186 X |
| 3,464,217 | * | 9/1969 | Streit | 405/185 |
| 4,157,229 | * | 6/1979 | Kumm | 405/185 |

* cited by examiner

*Primary Examiner*—Robert E. Pezzuto
(74) *Attorney, Agent, or Firm*—Mathew R. P. Perrone, Jr.

(57) ABSTRACT

A dive rescue search device has a stanchion with a locating mechanism for the device mounted thereon and a search area determining device based on a reel of rope cooperating therewith to properly direct the search.

20 Claims, 3 Drawing Sheets

DIVE RESCUE SEARCH DEVICE AND METHOD

CROSS-REFERENCE TO RELATED APPLICATION

This application is a continuation-in-part application based on U.S. patent application Ser. No. 09/182,704, filed Oct. 29, 1998, now U.S. Pat. No. 6,042,302, by the same inventor.

BACKGROUND OF THE INVENTION

This invention relates to a search and rescue device more particularly to a dive rescue search device designed to define the search area and a method for searching.

One of the primary functions, above and beyond the traditional fire fighting duties, of a fire department these days is search and rescue. In particular, the burden of doing underwater search or rescue usually falls to the fire department. For this purpose, fire departments need to have scuba divers.

A scuba diver is a highly-skilled person. These skills are well-used in search and rescue operations. To maximize the use of those skills, it is necessary to provide equipment to assist search procedures. The equipment must also be easy to use and to recover.

Such underwater rescues are very difficult procedures to complete. Accordingly, even though these matters are difficult to complete, it is highly desirable to do so in an efficient and thorough fashion so that the rescue, if possible, may be completed as quickly as possible. Speed of search is usually synonymous with a successful rescue.

Also, it is common for criminals to dispose of evidence underwater. Typical examples of underwater disposal elements include, but are not limited to, weapons, physical evidence from a crime scene, or other material. Such disposal of material in bodies of water is done, of course, in hopes that it will never be found. An efficient, underwater, search mechanism can create the greatest opportunity for recovery of the evidence.

It is very difficult to provide a mechanism, which can mark off a search area or search quadrant, so that the diver can be sure of the area, which has been searched. This is especially true in case of murky or unclear water. Such murky or unclear water is very common in the Midwestern United States.

The lakes and ponds and rivers common to the area contain water, which is rarely clear enough for an unassisted search, by a scuba diver. Some efficient marking device and method for the search area is required. Such a device or method can greatly add to search efficiency.

If the diver fails to search an area, it is a problem. If a diver searches the same area twice, unintentionally, it is a problem. Both of these problems add time to rescue or recovery. Solving these problems will greatly increase search efficiency.

It is desirable also to recover the rescue device. yet when such a device is deployed in water, it can be difficult to recover the same. If recovery of the search device can be provided in a more efficient manner, the use of the search device is still more efficient.

Various devices exist for assisting this search. However, it is complicated to use these devices on many occasions. If a device can be designed so that the search can be conducted simply, without backtracking over the same area while at the same time conducting an efficient search, great advantages can be obtained. The time used by the skilled diver is more effective, with a more clear marking out of the search area.

SUMMARY OF THE INVENTION

Among the many objectives of this invention is the provision of a dive rescue search device, capable of clearly defining the area searched.

A further objective of this invention is the provision of a dive rescue search device, with a stanchion.

A still further objective of this invention is the provision of a dive rescue search device, with a clear marking device for the search area.

Yet a further objective of this invention is the provision of a dive rescue search device, with an efficient recovery device.

Also an objective of this invention is the provision of a dive rescue search device, with an efficient deployment mechanism.

Another objective of this invention is the provision of a dive rescue search device, with a search area marker.

Still another objective of this invention is the provision of a dive rescue search device, with a clear diver marking area.

Yet another objective of this invention is the provision of a dive rescue search device, with an efficient positioning mechanism.

A further objective of this invention is the provision of a method for performing an efficient dive rescue search.

These and other objectives of the invention (which other objectives become clear by consideration of the specification, claims and drawings as a whole) are met by providing a dive rescue search device, having a stanchion with a locating mechanism for the device mounted thereon and a search area determining device cooperating therewith to properly direct the search.

BRIEF DESCRIPTION OF THE DRAWINGS

Throughout the figures of the drawings, where the same part appears in more than one figure of the drawings, the same number is applied thereto.

DESCRIPTION OF THE PREFERRED EMBODIMENTS

Figure 1:
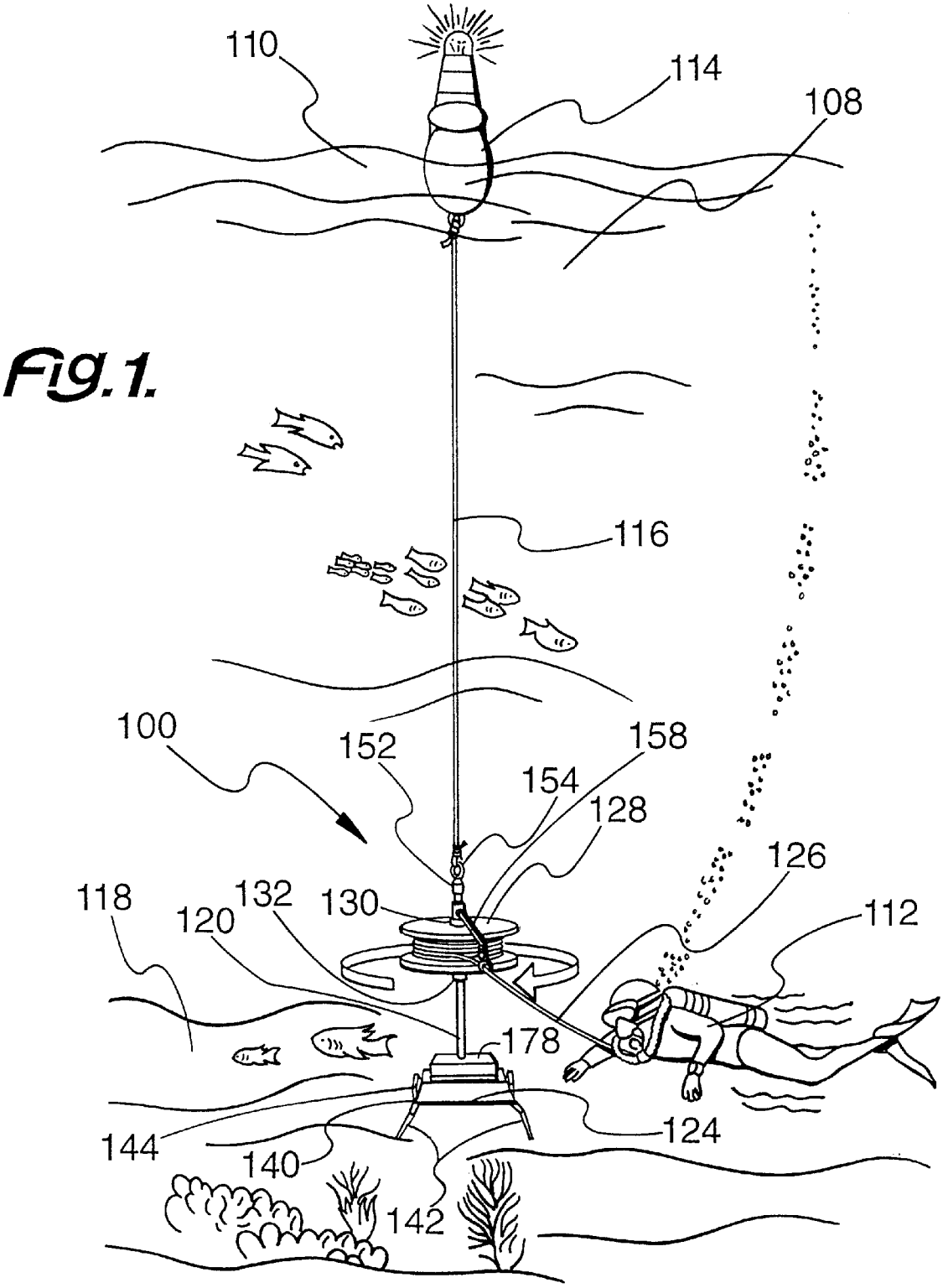
FIG. 1 depicts a perspective view of the dive rescue search device 100 of this invention in use.

The dive rescue search device of this invention includes a stanchion with various implements secured thereto. The stanchion includes a base with four legs. Extending upwardly from the base is a stanchion tube. Mounted on the stanchion tube, is a reel of rope. The reel has a specified diameter, which in turn gives a positive length of rope paid out. With such a predetermined length of rope, the search area is clearly defined.

In this fashion the reel of rope can replace the two swivel members of the parent application and provide for a simpler device. The strobe light string is replaced. To the top of the stanchion tube is secured a buoy, which floats on the surface of the body of water and indicates the location of the stand and, more importantly, the position of the diver.

In a preferred fashion, the reel has about 20 to about 40 meters of a length of rope, the rope being about 0.5 to about 2.0 centimeters in diameter wound around the reel. More preferably, the reel has about 25 to about 35 meters of a length of rope, the rope being about 0.7 to about 1.7 centimeters in diameter wound around the reel. Most preferably, the reel has about 30 to about 35 meters of a length of rope, the rope being about 0.8 to about 1.2 centimeters in diameter wound around the reel.

Dimensions of the reel are critical, because that is what determines the area of the search. It is critical that the reel have a height and a diameter to pay out about 1.2 meters (four feet) of rope with each rotation. The height of the reel is sufficient to minimize variations in the pay out of the rope.

The reel slides onto the stanchion at the reel aperture and is secured thereto with upper and lower bushings on top and bottom respectively. The bushings are held in place by any holding mechanism. The reel preferably does not rotate, so that line payout can be predictable. Usually at least one set screw and, preferably several set screws are used for each one of the bushings.

The height of the reel is adjustable from 30 centimeters (12 inches) to 1.2 meters (40 inches) vertically from the ground or bottom of the body of water on the stanchion. Once the reel is on the stanchion and the set screws are tightened, the reel is stationary and will not rotate.

On the stanchion above the reel is a rope guide consisting of a rotating bushing, an arm connected at one end to the bushing and an eye at the other end of the arm, through which the payout line is let out. The rope guide rotates freely on the stanchion tube. The basic operation once the device is set on the bottom of the body of water is as follows.

The diver holds the payout line in one hand and swims around the reel in a circular motion while searching the bottom visually or using his other hand. As the diver swims, he rope guide follows the diver's path and the payout line is released off the reel freely. In a highly preferred situation, The circumference of the drum or rope holding section of the reel is about 1.2 meters (4 feet). As the diver travels a 360 degree pass, about 1.2 meters (4 feet) of rope are released from the reel. The area searched becomes an ever increasing spiral covering all of the 200 foot diameter search area.

The circumference of the drum or rope holding section of the reel is about 0.7 to about 2 meters. More preferably, the circumference of the drum or rope holding section of the reel is about 0.8 to about 1.8 meters. Most preferably, the circumference of the drum or rope holding section of the reel is about 1.1 to about 1.3 meters.

This device in conjunction with the previously submitted device, as described in the above-referenced parent application, allows the systematic search of an area substantially in the shape of a circle, the circle having a diameter of about 65 meters (200 feet). The position of the diver is automatically controlled to allow a thorough search of the entire area. This device is especially useful for searches in water with limited visibility where tactile search is the only productive technique.

The device can be used for rescue or recovery of a drowned or nearly drowned victim. The device can be used to locate lost objects on the bottom of a body of water. The device may also be used for evidence recovery. The device may additionally be used for underwater mapping or surveying.

The reel and rope guide is preferably attached to the stanchion, before the device is deployed for use. A lowering rope is attached to the eye on top of the stanchion. The entire device is lowered to the bottom of the body of water. The device may be deployed off the side of a boat, or it may be floated out to the point of the start of a search area.

The point of the start, can be the last known position of the individual or object of the search. A buoy with a dive flag is attached to the lowering rope where the rope breaks the surface of the water. A diver enters the water and descends to the device using the lowering rope as a guide. The diver searches the immediate area around the device, while holding on to the pan of the device. The diver then unclips the payout line on the reel from the clips on the top flange of the reel.

Holding the rope in one hand the diver then swims in a predetermined direction, clockwise or counterclockwise. Depending on how the rope is wound on the reel the diver swims in the opposite direction. If the rope is wound in a counterclockwise direction the diver swims in a clockwise direction and vice versa. The direction of deployment is a matter of personal preference.

While swimming, the diver does a visual search or a tactile search of the target area. As the diver swims, the rope guide follows the diver and the diver's rope is released off the reel. When the diver searches a 100 foot radius all of the rope will be off the reel. Instead of being let out, the diver will start to be pulled in as the rope rewinds on the reel.

The diver is finished searching the target area when he feels the inward pull toward the reel. The diver can surface and the device can be removed from the water. The device can be removed using the lowering rope. The reel is then loosened on the stanchion, and the payout line is rewound on the reel. When the payout line is reloaded on the reel, the payout line pushes into small plastic clips on the drum of the reel. The clips keep the rope from coming off the reel when there is slack in the payout line or when the unit is not in use. The device is ready to be re-deployed in the next target area.

The base for the dive search rescue device includes a platform supported by three or more legs. Four legs provide the most effective support for the platform in the underwater environment. The platform is preferably square or rectangular in shape, with upwardly turned flanges at the edge thereof.

Due to shape of the platform, at least one weighted member may be added to the platform. Usually the weighted member has an aperture adapted to receive the stanchion tube. With a square or rectangular shape, the weight may held in position by the flanges. The weight members assist in the positioning of the dive search rescue device, by overcoming the buoyancy of the water.

Alternatively, one or more standard lead diver weights may be used. This standard lead diver weight is readily available, weighs about 4.5 kilograms (10 pounds), and has dimensions of about 2.5 centimeters (one inch) by 12.7 centimeters (5 inches) by 7.6 centimeters (three inches) such weights may be placed on the platform. Such standard weights may be simply placed on platform and held there by their own weight. Tape may also secure standard weight or weights in position. Other securing devices may be used for the weight or series of weights also.

Such removable weights permit the device to be disassembled easily and stored. The dive search rescue device can also be reassembled quickly when use is desired. This flexibility of use and storage makes this device extremely useful.

In FIG. 1, the dive search rescue device 100 is depicted as in use. The diver 112 is secured to the dive search rescue device 100 by payout line 126. The device 100 includes a weighted base 140 and a support stanchion tube 120. The support stanchion tube 120 is connected to a buoy line 116. A lighted buoy 114 is at the opposing end of the buoy line 116 and oppositely disposed from the support stanchion tube 120. In this fashion, the buoy 114 can appear on the surface 110 of the water 108 while making the position of the search device 100 well known.

On the support stanchion tube 120 is mounted a reel 128 to support payout line 126. Reel 128 is supported by an upper bushing 130 thereabove on support stanchion tube 120 and a lower bushing 132 therebelow on support stanchion tube 120. At least one set screw 134 secures each of upper bushing 130 and lower bushing 132 to support stanchion tube 120. Upper bushing 130 and lower bushing 132 cooperate to prevent to rotation of reel 128 on support stanchion tube 120.

Above upper bushing 130 rotatably mounted on support stanchion tube 120 is a rope guide 158 consisting of a swivel sleeve 160, a guide arm 162 connected at one end to swivel sleeve 160. A guide eye 164 through which the payout line 126 is let out. The rope guide 158 rotates freely on the stanchion tube 120, and permits dispensing of the payout line or payout line 126 for the diver 112 to use.

The base 140 has platform 124 with turned up flanges 144 at each edge thereof. A formed lead weight 178 slides over the support stanchion tube 120 down to the platform 124.

Figure 2:
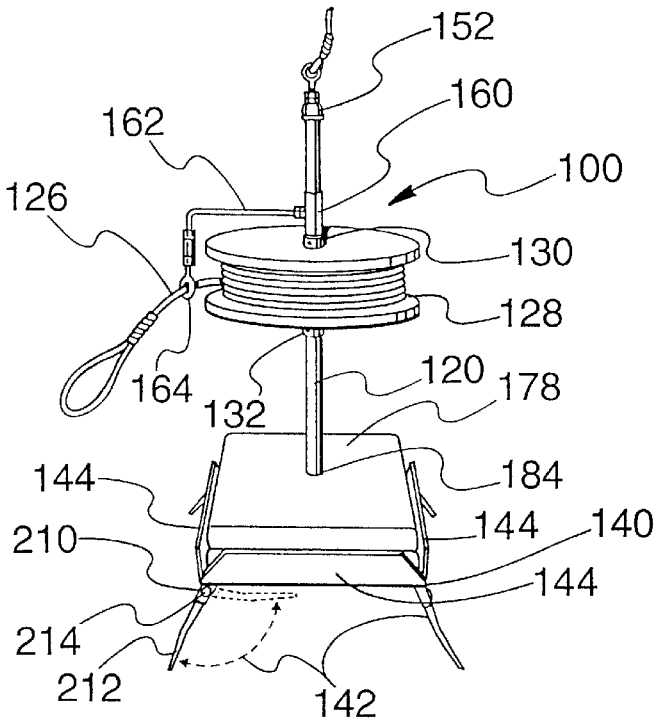
FIG. 2 depicts a perspective view of the support stanchion tube 120 for the dive rescue search device 100 of this invention.
Figure 4:
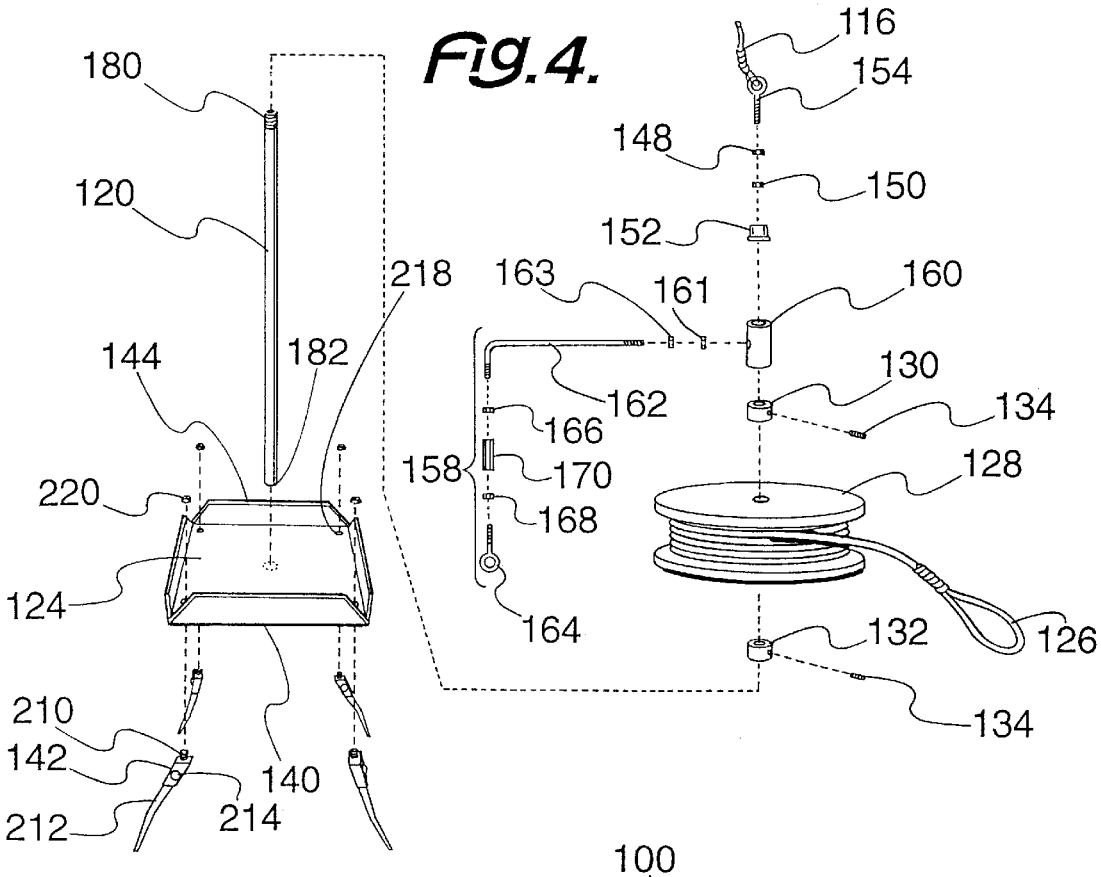
FIG. 4 depicts an exploded, perspective view of the support stanchion tube 120 for the dive rescue search device 100 of this invention.

Referring now to FIG. 2 and FIG. 4, on the support stanchion tube 120, is mounted an upper eye bolt 154. The upper eye bolt 154 receives the buoy line 116. The upper bushing 130 and the lower bushing 132 provide a height adjustment for reel 128 and rope guide 138. The upper bushing 130 and the lower bushing 132 are held in place by set screws 134.

The rope guide 158 is connected and fixed to the rotating bushing 160 by weld nut 161, and locked in place by lock nut 163. Rope guide 158 includes guide arm 162 and guide 164 are secured by fasteners to rotating bushing 160 in a standard fashion. The fasteners include top lock nut 166, coupling nut 170, and lower lock nut 168, as well as other suitable fasteners or substitutes.

Support stanchion tube 120 requires a securing device at both ends thereof. Support stanchion tube 120 has threaded end 180 to receive or couple to end cap 152. A weldable end 182 or otherwise securable end is secured to base 124.

Flanges 144 around platform 124 prohibit the flat lead weight 179 from rotating, because flat lead weight 179 has a shape similar to shape of the platform 124, formed by flanges 144. The flat lead weight 179 for the base 140 of the dive search rescue device 100 overcomes the buoyancy of the device 100. Platform 124 may of itself have sufficient weight, but removable weights provide for easier transportation and use of device 100. Centrally located in the formed lead weight 178 is an aperture 184 of sufficient size to permit formed lead weight 178 to slide over support stanchion tube 120, and onto platform 124.

The base 140 of the device 100 includes at least three legs 142, or preferably four legs 142. Legs 142 are preferably at the corner of the platform 124 of the base 140. Legs 142 may be secured to platform 124 by welding, bolting or another suitable mechanism. This device 100 thus has stability in the positioning of the device 100 on the sea floor 118.

In a preferred form each of leg 142 includes an upper portion 210 and a lower portion 212. Upper portion 210 is connected to lower portion 212 at folding joint 214. Upper portion 210 has an end threaded member 216 adapted to fit through platform aperture 218 and secured thereto with leg nut 220. Folding joint 214 permits lower portion 212 to be folded adjacent to platform 124.

Any number of formed lead weights 178 may be inserted over the support stanchion tube 120 in order to permit the base 140 to be properly supported and positioned on the sea floor 118, of the body of water 108 being searched. In this fashion buoyancy may be overcome.

The end cap tether assembly 154 includes a first eye bolt 146, a top lock nut 148, and a top weld nut 150. The top lock nut 148 and the top weld nut 150 fit into top upper eye bolt 146 and on end cap 152. End cap 152 fits on the threaded tube end 180 of the support stanchion tube 120.

The support stanchion tube 120 has a base end 182 welded or otherwise secured to the central portion of the base 140. Base end 182 of support stanchion tube 120 may be also screwed, welded or otherwise secured to base 140. Legs 142 are welded or otherwise secured to the base 140. A desirable number of formed lead weights 178 or other weighted accessory are slidable mounted or otherwise secured over the support stanchion tube 120.

Figure 3:
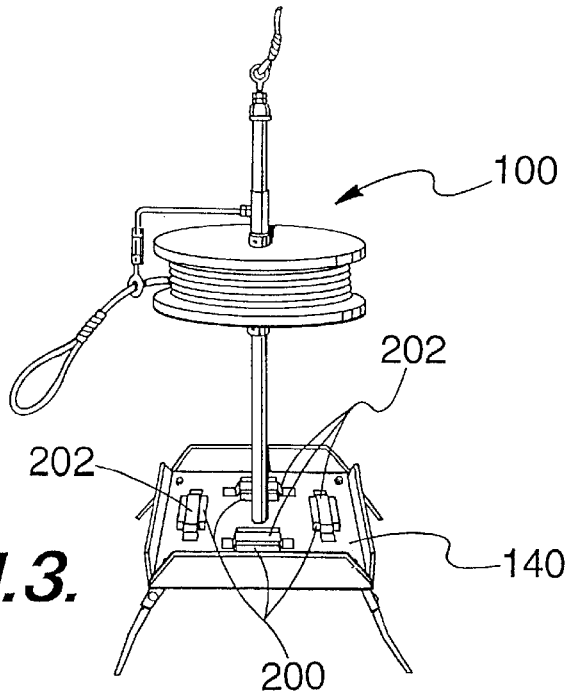
FIG. 3 depicts a perspective view of the free lead weight assembly 200 the dive rescue search device 100 of this invention.

As shown in FIG. 3, formed lead weight 178 is replaced by the standard lead diver weight 200. Such a standard lead diver weight 200 may be simply placed on platform 124 and held there by their own weight. Tape 202 may also secure weight or weights 200 in position.

Figure 5:
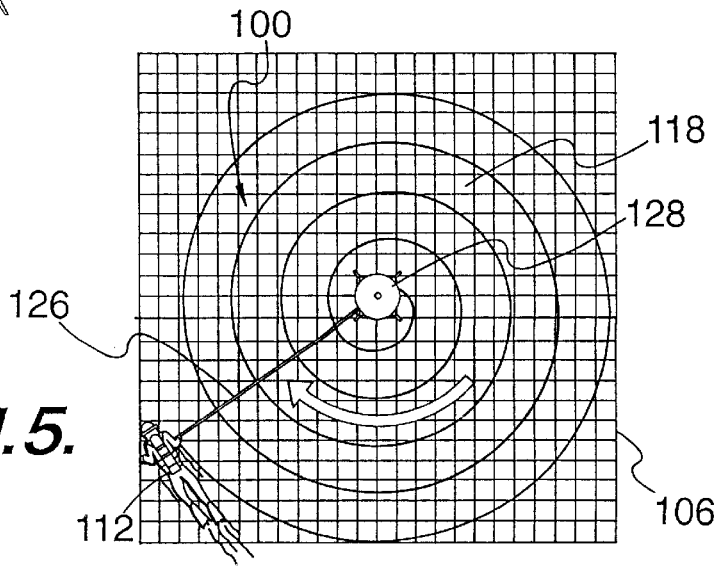
FIG. 5 depicts a top plan view of the dive rescue search device 100 of this invention, in use.

In FIG. 5, a top view of the sea floor 118 is depicted. With the diver 112, and the consistent use of payout line 126 as determined by diameter of reel 128 permits a grid 106 on the sea floor 118 to be very efficiently searched. The device 100 may be more efficiently set and used, because one payout line 126 does not require the strobe lights of the parent application, although such is permitted.

This application—taken as a whole with the specification, claims, abstract, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this method and apparatus can become clear to a person having ordinary skill in this particular art. Such modifications are clearly covered by this disclosure.

What is claimed and sought to be protected by Letters Patent of the United States is:

1. A dive rescue search device, having a locating mechanism and a search area determining device to properly direct a search of a specific area; the dive rescue search device comprising:

(a) a search area determining device including a stanchion being combined with a search area marker;

(b) the stanchion including a platform base;

(c) a stanchion tube extending upwardly from the platform base;

(d) the stanchion tube having a first tube end adjacent to the platform base;

(e) the stanchion tube having a second tube end oppositely disposed from the first tube end;

(f) the stanchion tube having a reel mounted thereon; and (g) the reel having a length of rope secured thereto.

2. The dive rescue search device of claim 1 further comprising:

(a) the reel having a specified diameter, in order to provide a known length of rope dispensed as a diver moves around the reel in a search pattern; and (b) a guide mechanism positioning the rope.

3. The dive rescue search device of claim 2 further comprising:

(a) the guide mechanism including a swivel member movably mounted on the stanchion tube; and (b) the guide mechanism including a guide eye for the rope oppositely disposed from the swivel member.

4. The dive rescue search device of claim 3 further comprising:

(a) the stanchion including a base with four legs;

(b) the second tube end having the device locating mechanism secured thereto;

(c) the base including a platform;

(d) a weight member being mounted on the platform in order to stabilize the dive rescue search device.

5. The dive rescue search device of claim 4 further comprising:

(a) the second tube end having the locating mechanism secured thereto;

(b) the locating mechanism including a buoy line and a floating member;

(c) the second tube end having the buoy line secured thereto at a first line end;

(d) the buoy line having second line end oppositely disposed from the first line end;

(e) the second line end having a floating member secured; and (f) the floating member secured being adapted to provide a location indicator for the dive rescue device as the dive rescue device is being used.

6. The dive rescue search device of claim 2 further comprising:

(a) the stanchion including a base with at least three legs;

(b) the second tube end having a device locating means secured thereto;

(c) the base including a platform; and (d) the platform receiving at least one weight in order to provide stability for the dive rescue search device.

7. The dive rescue search device of claim 6 further comprising:

(a) the platform including an upwardly turned flange for each edge thereof in order to support the at least one weight; and (b) the upwardly turned flange serving to position at least one weight element on the platform base.

8. The dive rescue search device of claim 7 further comprising:

(a) the at least one weight being secured to the platform by at least attaching device selected from the group consisting of an adhesive bond, a friction bond and a taping bond;

(b) the reel having the length of rope at about 20 to 40 meters; and (c) a diameter for the length of rope at about 0.5 to 2.0 centimeters.

9. The dive rescue search device of claim 7 further comprising:

(a) the reel being slidably mounted on the stanchion at the reel aperture;

(b) the reel being fixable on the stanchion at a desired position; and (c) a rope guide being rotatably mounted on the stanchion above the reel.

10. The dive rescue search device of claim 9 further comprising:

(a) the rope guide including a rotating bushing mounted on the stanchion;

(b) an arm for the rope guide being connected at a first arm end to the rotating bushing;

(c) an eye being adapted to receive the rope in a second arm end of the arm; and (d) the first arm end being oppositely disposed from the second arm end.

11. The dive rescue search device of claim 10 further comprising:

(a) the rope guide being adapted to rotate around the stanchion tube;

(b) an upper bushing and a lower bushing securing the reel to the stanchion tube;

(c) the upper bushing being closer to the locating mechanism than to the platform as the device is deployed; and (d) the lower bushing being closer to the platform than to the locating mechanism as the device is deployed.

12. The dive rescue search device of claim 11 further comprising:

(a) the floating member being a buoy; and (b) the upper bushing and the lower bushing each being secured by at least one set screw.

13. The dive rescue search device of claim 12 further comprising:

(a) the buoy being at least one selected from the group consisting an inflated buoy, a light-emitting buoy, and a solid buoy; and (b) the at least one set screw being at least two set screws.

14. The dive rescue search device of claim 13 further comprising:

(a) an end cap tether assembly securing the buoy line to the stanchion tube;

(b) the leg having an upper portion and a lower portion; and (c) a folding joint connecting the upper portion to the lower portion.

15. A dive rescue search device, having a locating mechanism and a search area determining device to properly direct a search of a specific area; the dive rescue search device comprising:

(a) a search area determining device including a stanchion combined with a search area marker;

(b) the stanchion including a platform base;

(c) a stanchion tube extending upwardly from the platform base;

(d) the stanchion tube having a first tube end adjacent to the platform base;

(e) the stanchion tube having a second tube end oppositely disposed from the first tube end;

(f) the stanchion tube having a reel mounted thereon;

(g) the reel having a length of rope secured thereto; and (h) the length of rope being adapted for removal from the reel in order to indicate a search area.

16. The dive rescue search device of claim 15 further comprising:

(a) the stanchion including a base with four legs;

(b) each of the four legs including a folding mechanism;

(c) the base including a platform;

(d) the folding mechanism providing for each of the four legs to have stored position parallel to the platform and a standing position providing support for the dive rescue search device on deployment; and (e) a guide mechanism positioning the length of rope.

17. The dive rescue search device of claim 16 further comprising:

(a) the guide mechanism including a swivel member movably mounted on the stanchion tube;

(b) the guide mechanism including a guide eye for the rope oppositely disposed from the swivel member;

(c) the second tube end having the device locating mechanism secured thereto;

(d) the base including a platform; and (e) a weight member being mounted on the platform in order to stabilize the dive rescue search device.

18. A method for conducting an underwater search and rescue operation by a diver comprising:

(a) providing a central location underwater;

(b) mounting a reel at the central location;

(c) providing rope on the reel;

(d) paying out the rope from the reel by the diver as the diver moves around the reel in order to remove the rope therefrom and to determine the search area.

19. The method of claim 18 further comprising:

(a) providing an above water marker from the central location;

(b) providing the reel with a specified diameter in order to determine a searched area searched;

(c) comparing the search area with a desired search pattern; and (d) determining the results of the search.

20. The method of claim 19 further comprising the above water marker being a buoy secured to the central location.

* * * * *